US012195139B2

(12) United States Patent
Faulkner et al.

(10) Patent No.: US 12,195,139 B2
(45) Date of Patent: Jan. 14, 2025

(54) PORTABLE AND INFLATABLE MARINE VESSEL CANOPY

(71) Applicants: Rory Faulkner, St. Petersburg, FL (US); Sebastian Singer Vikkelsoe, St. Petersburg, FL (US); Joshua Marcus, Gulfport, FL (US)

(72) Inventors: Rory Faulkner, St. Petersburg, FL (US); Sebastian Singer Vikkelsoe, St. Petersburg, FL (US); Joshua Marcus, Gulfport, FL (US)

(73) Assignee: Flight Dive LLC, St. Petersburg, FL (US)

( * ) Notice: Subject to any disclaimer, the term of this patent is extended or adjusted under 35 U.S.C. 154(b) by 0 days.

(21) Appl. No.: 18/693,098

(22) PCT Filed: Sep. 19, 2022

(86) PCT No.: PCT/US2022/043936

§ 371 (c)(1),
(2) Date: Mar. 18, 2024

(87) PCT Pub. No.: WO2023/044088

PCT Pub. Date: Mar. 23, 2023

(65) Prior Publication Data

US 2024/0270350 A1 Aug. 15, 2024

Related U.S. Application Data

(60) Provisional application No. 63/245,273, filed on Sep. 17, 2021.

(51) Int. Cl.

| | |
|---|---|
| ***B63B 17/02*** | (2006.01) |
| ***E04H 15/06*** | (2006.01) |
| ***E04H 15/20*** | (2006.01) |

(52) U.S. Cl.
CPC ..... *B63B 17/02* (2013.01); *E04H 15/06* (2013.01); *E04H 15/20* (2013.01); *E04H 2015/201* (2013.01)

(58) Field of Classification Search
CPC ..... E04H 15/02
See application file for complete search history.

(56) References Cited

U.S. PATENT DOCUMENTS 3,338,001 A * 8/1967 Fraser ..... E04H 15/20 52/2.21
4,171,595 A * 10/1979 Tucker ..... A47K 3/325 52/2.21

(Continued)

FOREIGN PATENT DOCUMENTS

DE 4211308 C1 * 9/1993 ..... E04H 15/20
DE 102021123925 A1 * 3/2023 ..... B63B 17/02

(Continued)

*Primary Examiner* — David R Dunn
*Assistant Examiner* — Danielle Jackson
(74) *Attorney, Agent, or Firm* — Johnson | Dalal; Mark C. Johnson

(57) ABSTRACT

A portable and inflatable marine vessel canopy that is operably configured to shield a user on a marine vessel from the elements, such as rain, wind, UV rays, and sunlight, and to be selectively positioned into various configurations on a marine vessel to provide the optimum amount of shade and protection. The present invention beneficially reduces the damage, discomfort, and inconvenience caused by users' exposure to the elements and comprises a plurality of covering panels coupled to a flexible tubular frame, the canopy operably configured to selectively removably couple to a Bimini top, T-top, or other boat cover, canvas, or canopy structure (or to the marine vessel itself) using a plurality of fasteners coupled to the flexible tubular frame.

14 Claims, 13 Drawing Sheets

(56) References Cited

U.S. PATENT DOCUMENTS

| | | | | |
|---|---|---|---|---|
| 6,263,617 | B1 * | 7/2001 | Turcot | E04H 15/20 52/2.13 |
| 9,499,970 | B2 * | 11/2016 | Milo | E04B 1/165 |
| 10,132,100 | B1 * | 11/2018 | Akad | E04D 13/106 |
| 10,563,422 | B2 * | 2/2020 | Marty | B29C 73/34 |
| 10,890,010 | B1 * | 1/2021 | Chang | E04H 15/20 |
| 2008/0044614 | A1 | 2/2008 | Hannon | |
| 2008/0125005 | A1 * | 5/2008 | Lu | A63H 33/008 446/222 |
| 2014/0018208 | A1 | 1/2014 | Takaishi et al. | |
| 2015/0032106 | A1 | 11/2015 | Begando et al. | |
| 2016/0201351 | A1 * | 7/2016 | Pirkle | E04H 15/20 135/121 |
| 2016/0279499 | A1 * | 9/2016 | Henderson | E04H 15/14 |
| 2018/0026613 | A1 | 1/2018 | Zyuban et al. | |
| 2020/0033255 | A1 | 1/2020 | Chen | |
| 2022/0098893 | A1 * | 3/2022 | Chen | B60P 3/341 |

FOREIGN PATENT DOCUMENTS

| | | | | |
|---|---|---|---|---|
| EP | 1970301 | A1 | 9/2008 | |
| JP | 2010125305 | A | 10/2010 | |
| WO | WO-2014080391 | A1 * | 5/2014 | E04H 15/20 |

* cited by examiner

PORTABLE AND INFLATABLE MARINE VESSEL CANOPY

FIELD OF THE INVENTION

The present invention relates generally to marine vessels and, more particularly, relates to a portable and inflatable canopy operably configured to be selectively inflated, deflated, and adjusted in various configurations on a marine vessel.

BACKGROUND OF THE INVENTION

A significant drawback of open boats and marine vessels is the damage, discomfort, and inconvenience caused by users' exposure to the elements, e.g., rain, wind, sun, etc. Without any type of canopy structure overhead to provide relief from persistent sunlight and precipitation, users may find themselves, at best, becoming sunburnt or soaked or, at worst, experiencing excess sun exposure, sun poisoning, etc. Existing prior art, such as Bimini tops and T-tops, provide some relief from the elements but are nevertheless characterized by significant limitations. Specifically, such structures fail to provide complete coverage from weather events because they generally only cover the area directly overhead, while leaving the sides entirely exposed. In this way, a user standing under a Bimini top or T-top may be spared from rain or sunlight coming from overhead but will nonetheless suffer the effects of the rain, wind, sunlight, and other weather elements coming from the back or sides of the marine vessel. Existing shade extension systems, meanwhile, all require some type of permanent installation and are not free to rotate, cantilever, or simply move at any moment, nor are any of them inflatable.

Furthermore, known canopies or inflatable covering structures are also quite cumbersome, time-intensive, and cost-intensive to install and remove from a marine vessel. To that end, these known canopies or inflatable covering structures are also impossible or impracticable to transport by users without the use of external equipment or help.

Therefore, a need exists to overcome the problems with the prior art as discussed above.

SUMMARY OF THE INVENTION

The invention provides a portable and inflatable marine vessel canopy that overcomes the hereinafore-mentioned disadvantages of the heretofore-known devices and methods of this general type and that enables quick, effective, and efficient installation and decoupling of a shade to a marine vessel and provides users with significantly wider and broader protection from the elements such as sunrays and rain during use.

With the foregoing and other objects in view, there is provided, in accordance with the invention, a portable and inflatable marine vessel canopy comprising a flexible tubular frame having a plurality of frame elements coupled together and each defining an enclosed internal frame channel, the flexible tubular frame having an inflation valve coupled thereto and operably configured to provide fluid communication to the enclosed internal frame channel of the plurality of frame elements and to generate an inflated, hermetically sealed, and enclosed frame configuration with the plurality of frame elements defining a frame opening; a plurality of covering panels each of a polymeric and flexible material and each coupled to the flexible tubular frame, covering the frame opening, and disposed in overlapping and spaced apart configuration with one another; and a plurality of fasteners coupled to the flexible tubular frame and operably configured to selectively removably couple to a marine vessel.

In accordance with a further feature of the present invention, the flexible tubular frame is of a polyurethane material.

In accordance with a further feature of the present invention, the inflated frame configuration further comprises a central planar frame portion flanked by two angled frame portions.

In accordance with another feature of the present invention, the inflated frame configuration further comprises two lateral frame elements spanning to and from two opposing sides of the inflated and enclosed frame configuration and separating the frame opening into side frame openings and a central frame opening.

In accordance with yet another feature of the present invention, the inflated frame configuration also comprises a central planar frame portion defined by the two lateral frame elements and having the central frame opening, the central planar frame portion flanked by two angled frame portions each having one of the side frame openings.

In accordance with a further feature of the present invention, one of the plurality of covering panels covers the central frame opening and includes two portions operably configured to be selectively uncoupled from one another with a zipper assembly to expose the central frame opening.

In accordance with another feature of the present invention, the two lateral frame elements are disposed in a co-planar and parallel configuration with one another.

In accordance with another feature, an embodiment of the present invention includes lateral inflation apertures each respectively defined by, and disposed proximal to opposing ends of, the two lateral frame elements, wherein the two lateral frame elements each define an enclosed frame channel fluidly coupled to lateral inflation apertures respectively defined by the lateral frame element thereon and independently fluidly uncoupled to the enclosed frame channel defined by the plurality of frame elements generating the inflated and enclosed frame configuration; and inflation apertures defined by the plurality of frame elements generating the inflated and enclosed frame configuration and each respectively in fluid and hermetically sealed communication with the lateral inflation apertures with a plurality of hoses.

In accordance with another feature of the present invention, the covering panels covering the central frame opening are maintained in a rolled configuration by at least one tethering strap.

In accordance with a further feature of the present invention, the enclosed frame channel defined by the plurality of frame elements generating the inflated and enclosed frame configuration is continuously defined by the plurality of frame elements.

In accordance with yet another feature of the present invention, the plurality of covering panels are of a polyethylene terephthalate material.

In accordance with a further feature of the present invention, the plurality of covering panels are each coupled to the flexible tubular frame around a perimeter defined by the plurality of frame elements generating the inflated and enclosed frame configuration.

In accordance with another feature of the present invention, the plurality of covering panels overlap by approximately two inches.

In accordance with a further feature of the present invention, the plurality of covering panels are directly coupled together by stitching at discontinuous points.

In accordance with yet another feature of the present invention, the plurality of fasteners comprise a first loop defining a fastener channel, wherein each of the frame elements are operably configured to be disposed within the fastener channel, and a secondary loop defining a loop channel.

Although the invention is illustrated and described herein as embodied in a portable and inflatable marine vessel canopy, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the canopy.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION OF THE INVENTION

To reduce the damage, discomfort, and inconvenience caused by users' exposure to the elements, e.g., rain, wind, sun, etc., on exposed or open-air marine vessels, the present invention provides a portable and inflatable marine vessel canopy that overcomes the heretofore-mentioned disadvantages of the heretofore-known devices and methods of this general type and that is operably configured to be selectively inflated, deflated, and adjusted in various configurations on a marine vessel and, more specifically, on a Bimini top, T-top, or other boat cover. Additionally, the present invention does not require any drilling, screwing, or other permanent and time-consuming methods of attaching the canopy to a boat. Unlike existing shade extension systems which require some kind of permanent installation and are not inflatable or free to rotate, cantilever, or simply move at any moment, the present invention provides for quick and easy installation that does not require the use of external tools such as drills, screws, hammers, etc.

The present invention provides a portable and inflatable marine vessel canopy 100 (hereinafter referred to as "canopy 100" for brevity). Embodiments of the invention provide a canopy 100 that is operably configured to attach to a Bimini top, T-top, or other boat cover, canvas, or canopy structure (or to the marine vessel itself) and to beneficially provide a greater surface area of shade and protection from the elements to users operating, or riding in, the marine vessel. In this way, the canopy 100 has been designed to overcome at least one significant limitation with existing prior art, namely, the failure to provide complete coverage from weather events, e.g., rain, wind, sunlight, etc., because existing prior art generally only covers the area directly overhead of the user while leaving the sides entirely exposed to the elements.

Figure 1:
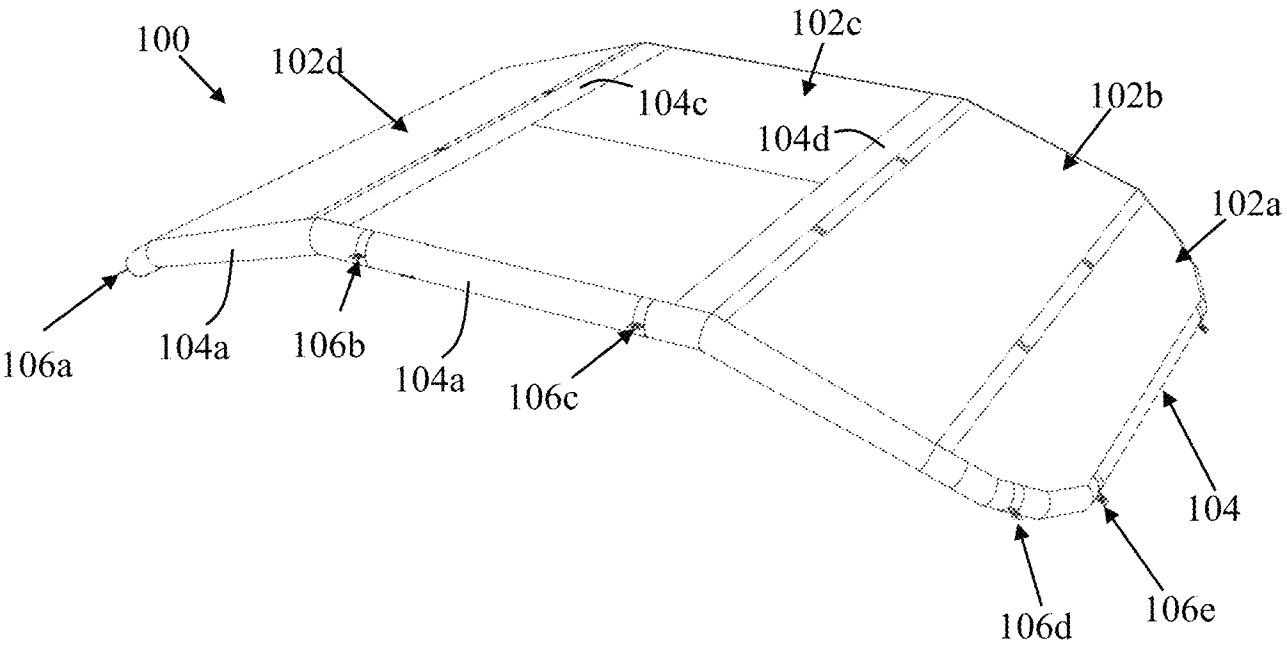
FIG. 1 is a perspective view of a portable and inflatable marine vessel canopy in accordance with one embodiment of the present invention.
Figure 2:
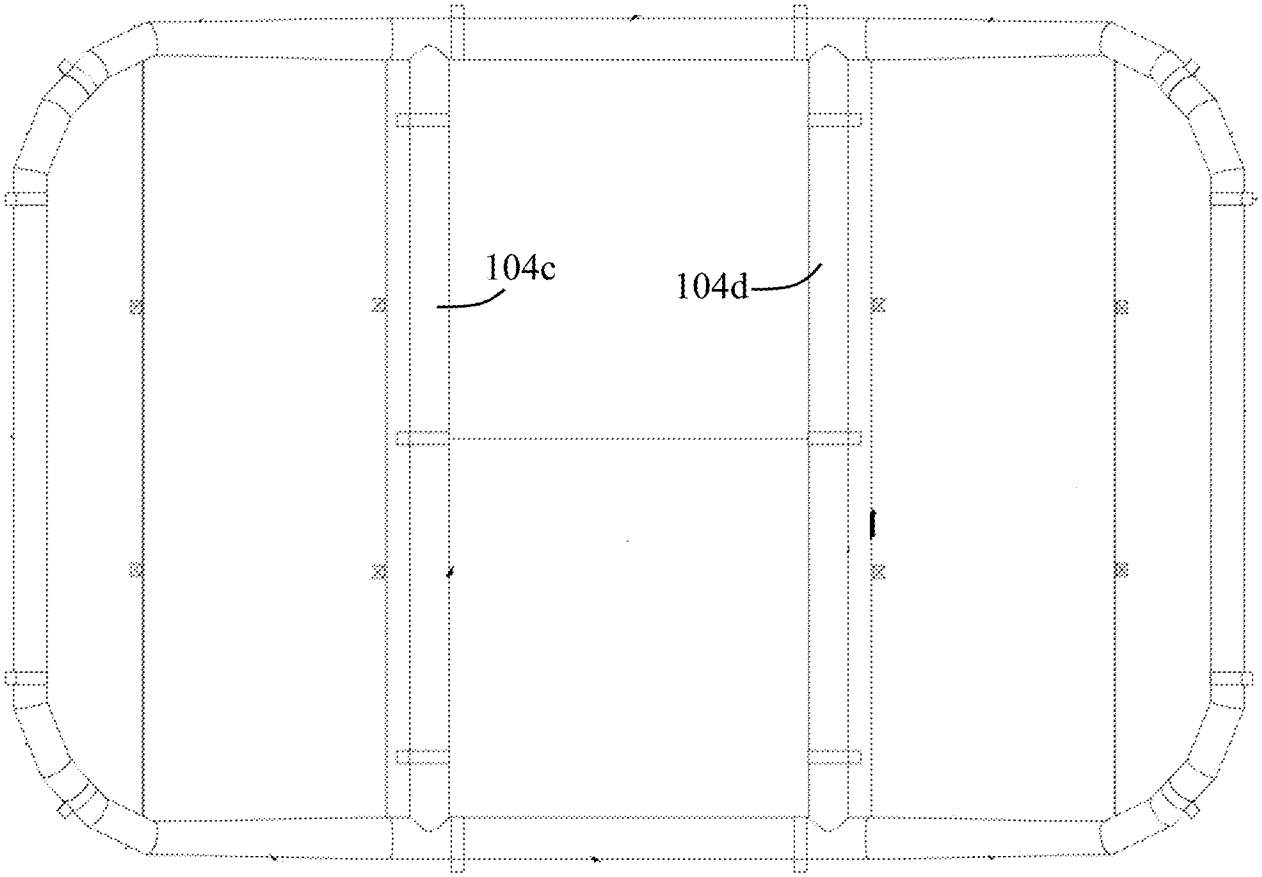
FIG. 2 is a bottom plan view of the portable and inflatable marine vessel canopy in FIG. 1 and further depicting a plurality of frame elements (represented with numerals 1-22*a-b*)
Figure 3:
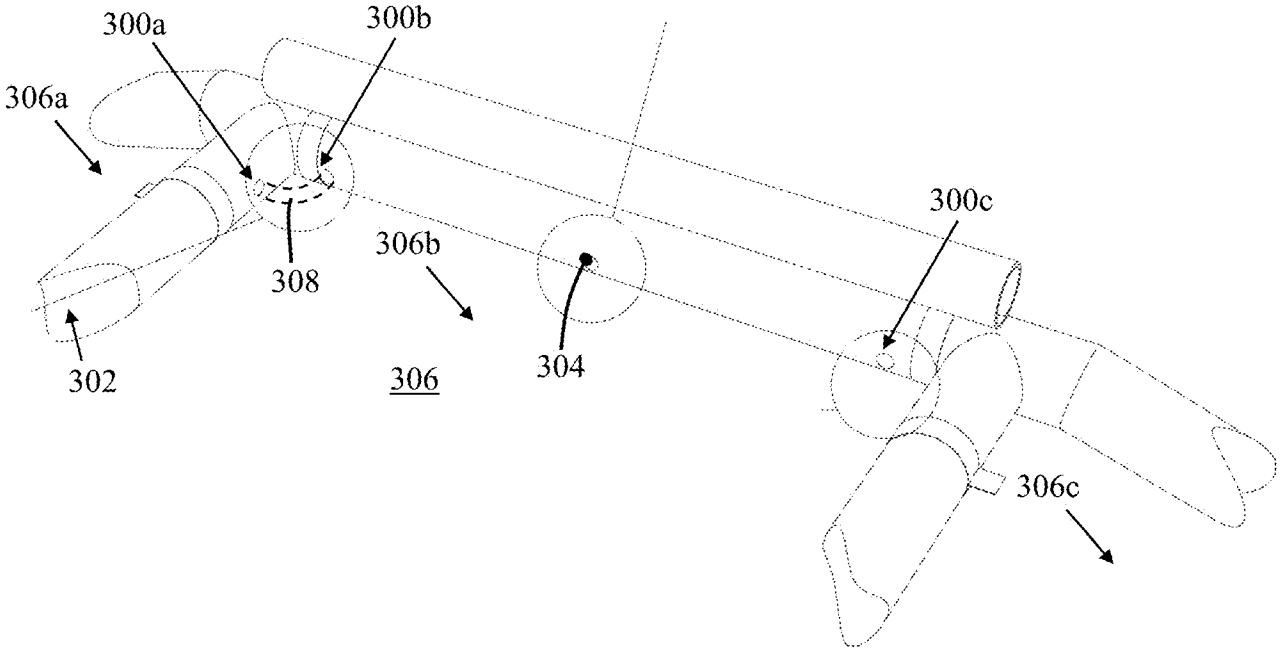
FIG. 3 is a fragmentary close-up view of a flexible tubular frame utilized with the portable and inflatable marine vessel canopy in accordance with an exemplary embodiment of the present invention.
Figure 4:
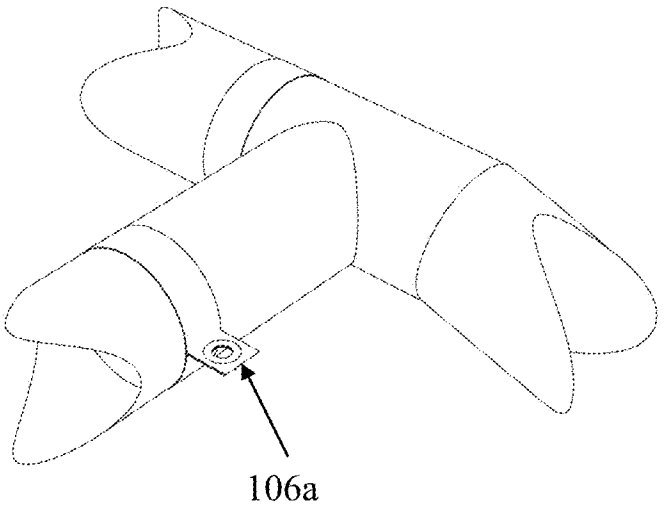
FIG. 4 is another fragmentary close-up view of a flexible tubular frame and a vessel attachment structure utilized with the portable and inflatable marine vessel canopy in accordance with an exemplary embodiment of the present invention.
Figure 5:
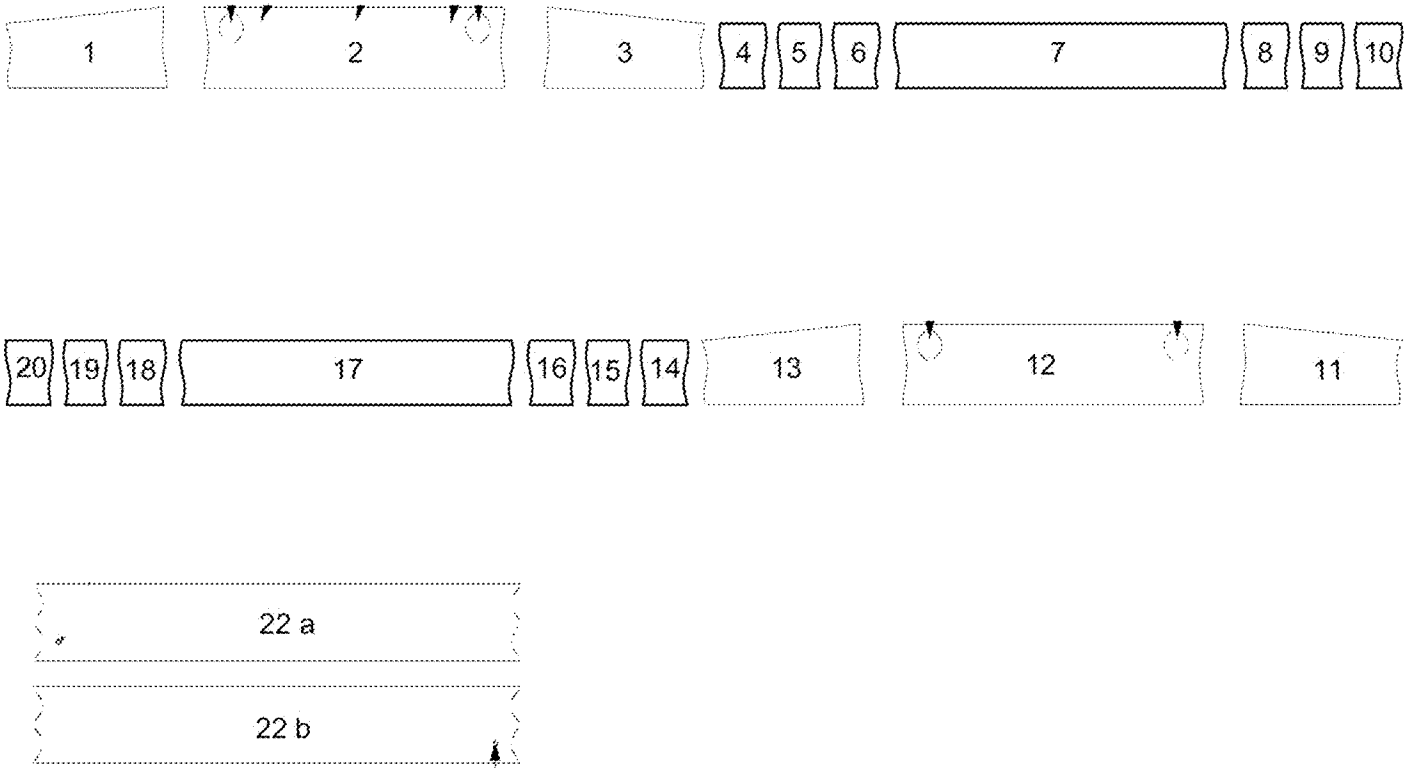
FIG. 5 is a diagram depicting the cutting pattern for the flexible tubular frame utilized with the portable and inflatable marine vessel canopy and further depicting the plurality of frame elements in FIG. 2 in accordance with an exemplary embodiment of the present invention.

Referring now to FIG. 1, the canopy 100 is depicted in a perspective top view. As shown in FIG. 1, the canopy 100 comprises a plurality of covering panels 102*a-n,* wherein "n" refers to any number greater than one, coupled to a flexible tubular frame 104, the canopy 100 operably configured to selectively removably couple to a marine vessel. The flexible tubular frame 104 defines the internal structure, shape, and overall form of the canopy 100. FIGS. 2-4 depict the flexible tubular frame 104. The flexible tubular frame 104 comprises a plurality of frame elements 104*a-n* coupled together and each defining an enclosed internal frame channel 302 (referred to herein as "channel 302" for brevity or, alternatively, as the "main bladder" and the "strut bladder" defined by two lateral frame elements 104*c,* 104*d* connected with a hose). The flexible tubular frame 104 has an inflation valve 304 coupled thereto that is operably configured to provide fluid communication to the enclosed internal frame channel 302 of the plurality of frame elements 104*a-n* and to generate an inflated, hermetically sealed, and enclosed frame configuration (see, e.g., FIG. 1) with the plurality of frame elements 104*a-n* defining a frame opening 306. The flexible tubular frame 104 is selectively inflatable via the inflation valve 304 disposed on the flexible tubular frame 104. In a preferred embodiment, the flexible tubular frame 104 is of a polyurethane material or another equivalent or comparable material composition. Beneficially, the material composition of the flexible tubular frame 104 is mildew resistant, abrasion resistant, and tear resistant, which are all crucial qualities on a marine vessel. Due to the frequent and high exposure to water, sun, and salt, the flexible tubular frame 104 should preferably be able to withstand abrasion and mildew growth.

Figure 13:
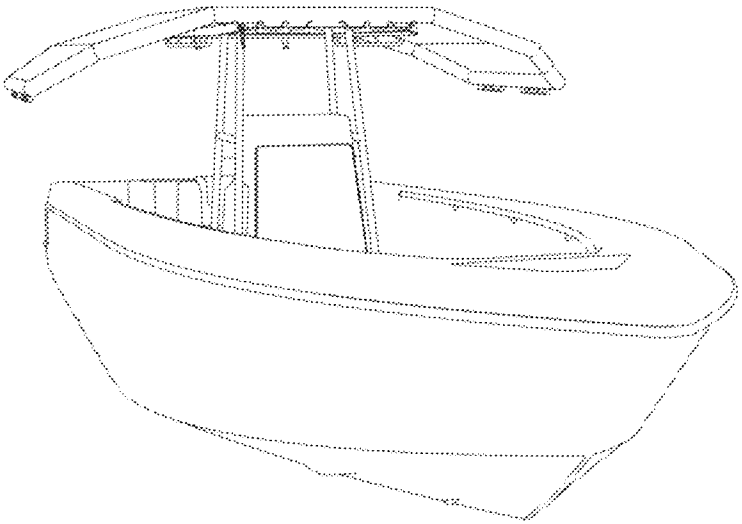
FIGS. 13-15 are perspective views of a portable and inflatable marine vessel canopy selectively removably coupled to a marine vessel in accordance with embodiments of the present invention.
Figure 14:
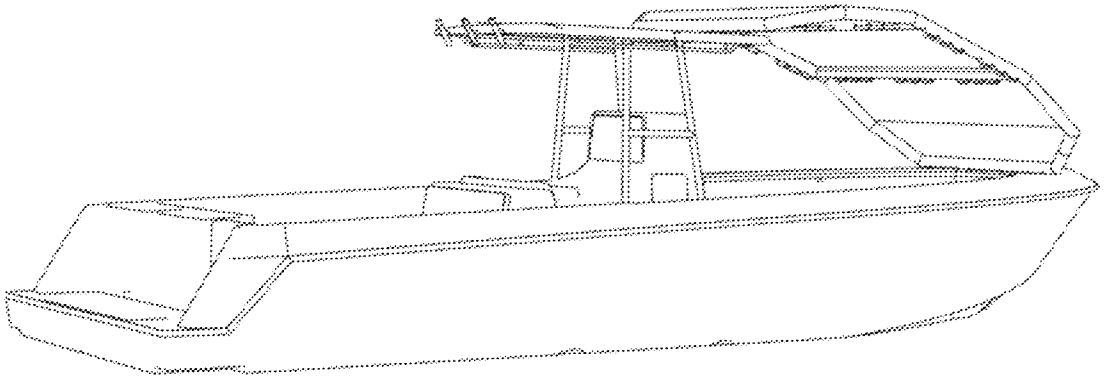
Figure 15:
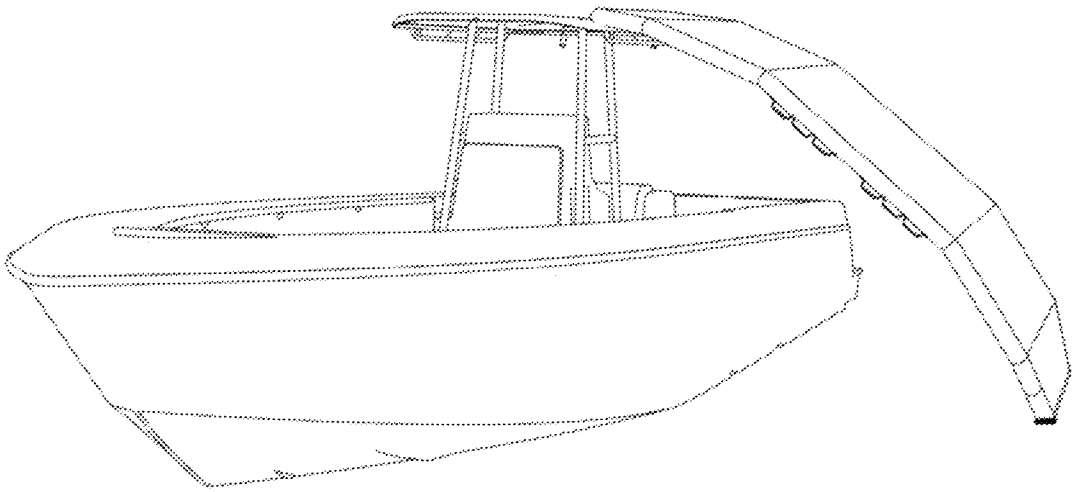

In order to effectively accommodate the exemplary configurations depicted in FIGS. 13-15, the inflated frame configuration further comprises a central planar frame portion flanked by two angled frame portions. Specifically, the two angled frame portions enable the canopy 100 to be positioned into different configurations on a boat so as to provide the optimum amount of shade to users.

As depicted in FIG. 2, the inflated frame configuration may also comprise two lateral frame elements 104*c,* 104*d* spanning to and from two opposing sides of the inflated and enclosed frame configuration and separating the frame opening 306 into side frame openings 306*a,* 306*c* and a central frame opening 306*b*. The frame openings 306*a-c* are depicted in FIG. 3 and further facilitate the positioning of the canopy 100 in different configurations that provide optimum shade and protection from the elements. The inflated frame configuration comprises a central planar frame portion defined by the two lateral frame elements 104*c,* 104*d* and having the central frame opening 306*b,* the central planar frame portion flanked by two angled frame portions each having one of the side frame openings 306*a,* 306*c*. As seen in FIG. 2, the two lateral frame elements 104*c,* 104*d* are disposed in a co-planar and parallel configuration with one another. In an exemplary embodiment, the central frame opening 306*b* is selectively and partially removable to expose the area above the central frame opening 306*b*. Specifically, one of the plurality of covering panels 102*a-n* covers the central frame opening 306*b* and includes two portions operably configured to be selectively uncoupled from one another with a zipper assembly to expose the central frame opening 306*b*. In this way, the user is provided access to electronics and other structures disposed on the top of the marine vessel. Moreover, the user is able to control the amount of exposure to sunlight, for example, by selectively uncoupling the two portions of the plurality of covering panels 102*a-n* and exposing the central frame opening 306*b*. In inclement weather or episodes of high UV sunlight, the user may elect to keep the central frame opening 306*b* covered with the plurality of covering panels 102*a-n.*

In a preferred embodiment, the canopy 100 further comprises lateral inflation apertures 300*a* each respectively defined by, and disposed proximal to, opposing ends of the two lateral frame elements 104*c,* 104*d,* wherein "proximal to" as used herein is defined as being at or near, within 1-3 inches or less than 10% of the overall length. The two lateral frame elements 104*c,* 104*d* each define an enclosed frame channel fluidly coupled to the lateral inflation apertures 300*a* respectively defined by the lateral frame element thereon and independently fluidly uncoupled to the enclosed frame channel 302 defined by the plurality of frame elements 104*a-n* generating the inflated and enclosed frame configuration. Said differently, the internal channel is not connected to the enclosed frame channel 302 unless using an object, such as a hose 308. Inflation apertures 300*b,* 300*c* are defined by the plurality of frame elements 104*a-n* generating the inflated and enclosed frame configuration and each respectively are in fluid and hermetically sealed communication with the lateral inflation apertures 300*a* with a plurality of hoses (e.g., comparable to hose 308). The lateral inflation aperture 300*a* and inflation apertures 300*b,* 300*c* are operably configured to facilitate the fluid movement of air to beneficially calibrate, balance, and maintain an optimum air pressure within the enclosed frame channel as needed. In turn, this ensures the flexible tubular frame 104 retains its intended shape and structure. Preferably, the air pressure within the flexible tubular frame 104 should be sufficiently high (e.g., 7-12 psi) to maintain the rigid structure of the canopy 100 during use and to support the plurality of covering panels 102*a-n* thereon.

The covering panels 102*a-n* covering the central frame opening 306*b* are maintained in a rolled configuration by at least one tethering strap. The tethering strap is looped around the rolled covering panels 102*a-n* and tied to keep the rolled covering panels 102*a-n* from unfurling.

The plurality of covering panels 102*a-n* are each of a polymeric and flexible material and are each coupled to the flexible tubular frame 104, covering the frame opening 306, and disposed in overlapping and spaced apart configuration with one another. In an exemplary embodiment, the plurality of covering panels 102*a-n* are of approximately 110 square feet of polyester fabric (e.g., the trademarked fabric known in the industry as Dacron® or polyester film commercially referred to as "KPE") that is not absorbent, making it resistant to mildew, mold, and stains since it cannot retain water or other liquids. The polymeric and flexible material composition is also preferably a UV- and sun-resistant fabric that has been treated to withstand UV rays. UV rays have a shorter wavelength than visible light and a longer wavelength than X-rays. This wavelength makes them particularly good at penetrating through objects, which is how they can cause damage to users and property, e.g., the fading or discoloration of fabrics and objects. Prolonged exposure to UV rays can cause materials to break down. In the case of outdoor fabrics, UV rays can cause a chemical reaction with the dyes in the fabric or with the man-made plastic (polymer) yarns of the fabric itself. The breakdown of the dye or fiber is what causes fading. This process is known as "photo degradation." Fabrics that have been treated to withstand UV rays cannot withstand all UV rays for an indefinite amount of time but are able to resist significant fading for the expected lifetime of the fabric, furniture, etc. For this reason, the plurality of covering panels 102*a-n* are preferably of a UV fabric and are preferably free of any apertures that would otherwise cause UV rays to pierce therethrough. An exemplary weight of the plurality of covering panels 102*a-n* is 4 oz to 6 oz. In an exemplary embodiment, the plurality of covering panels 102*a-n* are of a polyethylene terephthalate ("PET") material. The overlapping and spaced apart configuration of the plurality of covering panels 102*a-n* are also beneficial in that said configuration allows the wind to pass through while simultaneously covering the frame opening 306 when the frame 104 is inflated. Specifically, the overlapping covering panels 102*a-n* alleviate air pressure from movement and/or wind gusts to prevent the canopy 100 from becoming damaged, broken, etc. In one embodiment, the plurality of covering panels 102*a-n* overlap by approximately two inches to provide enough space for wind to pass through while also overlapping enough to prevent any gaps in coverage from sun exposure.

The plurality of covering panels 102*a-n* are each coupled to the flexible tubular frame 104 around a perimeter defined by the plurality of frame elements 104*a-n* generating the inflated and enclosed frame configuration. The covering panels 102*a-n* are also directly coupled together by stitching at discontinuous points, i.e., defined by separate sections that also are connected with a separate structure, such as the hose 308.

The enclosed frame channel 302 defined by the plurality of frame elements 104*a-n* generating the inflated and enclosed frame configuration is continuously defined by the plurality of frame elements 104*a-n*. As opposed to being discontinuous (i.e., defined by separate sections that also are connected with a separate structure, such as the hose 308), the enclosed frame channel 302 is continuous, which beneficially enables the lateral inflation apertures 300*a* and inflation apertures 300*b*, 300*c* to achieve their intended purpose, i.e., to facilitate the fluid movement of air to beneficially calibrate, balance, and maintain an optimum air pressure within the enclosed frame channel 302 which, in turn, maintains the inflated structure of the flexible tubular frame 104.

The canopy 100 also comprises a plurality of fasteners 106*a-n* coupled to the flexible tubular frame 104 and operably configured to selectively removably couple to a marine vessel at approximately 14 to 18 contact points. In one embodiment (depicted in FIG. 4), the plurality of fasteners 106*a-n* comprise a first loop defining a fastener channel, wherein each of the frame elements 104*a-n* are operably configured to be disposed within the fastener channel, and a secondary loop defining a loop channel, wherein a strap, rope, or other fastening means is operably configured to be disposed within the loop channel to secure the canopy 100 in place on a marine vessel. In a preferred embodiment, the plurality of fasteners 106*a-n* are in the form of webbing and grommets (as best seen in FIG. 4) disposed on the flexible tubular frame 104 and are used to secure the canopy 100 to a marine vessel with webbing straps for easy and fast installation. The webbing straps may consist of 6 non-adjustable, short straps that are 10 inches in length and/or 4 long straps that are 6 to 12 feet in length with at least one adjustable buckle. In alternate embodiments, a comparable fastening means may be utilized in place of, or in addition to, the adjustable webbing straps and grommets.

Preferably, the canopy 100 comprises approximately 18 fasteners 106*a-n* disposed along the outer perimeter of the flexible tubular frame 104 (as best seen in FIG. 2) to facilitate a secure, reliable, and continuous attachment of the canopy 100 to the marine vessel that is capable of remaining substantially attached despite air resistance (as well as rain, hail, and other potential environmental factors) during operation of the marine vessel. In one embodiment, the flexible tubular frame 104 is of a thermoplastic polyurethane (TPU) composition with properties of high elasticity, high abrasion resistance, and high durability to withstand repeated and/or continued use in outside environments, though alternate embodiments may incorporate other substantially comparable constituents.

Figure 7:
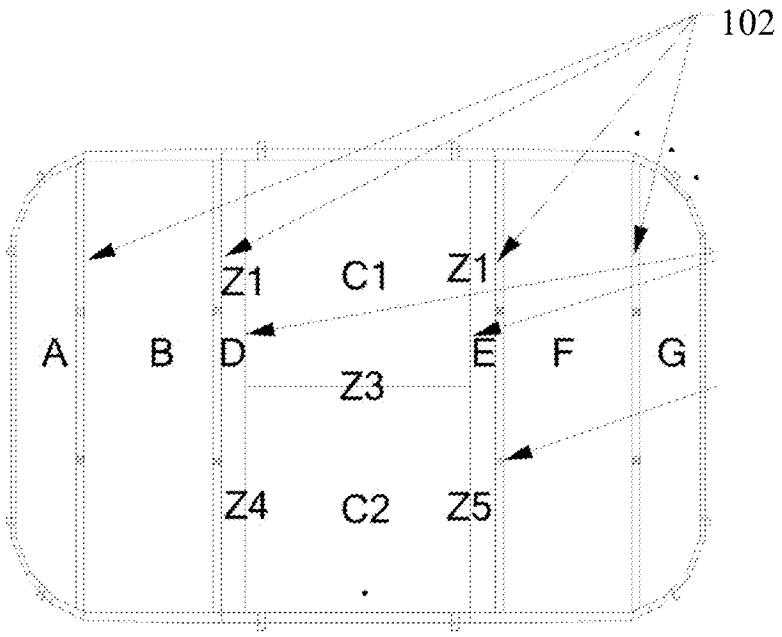
FIG. 7 is a top plan view of the portable and inflatable marine vessel canopy in FIG. 1, wherein "A", "B", "C", "D", "E", "F", "G" represent panels utilized in the marine vessel canopy and "Z1", "Z2", "Z3", "Z4", "Z5" represent zippers utilized in the marine vessel canopy in accordance with embodiments of the present invention.
Figure 6:
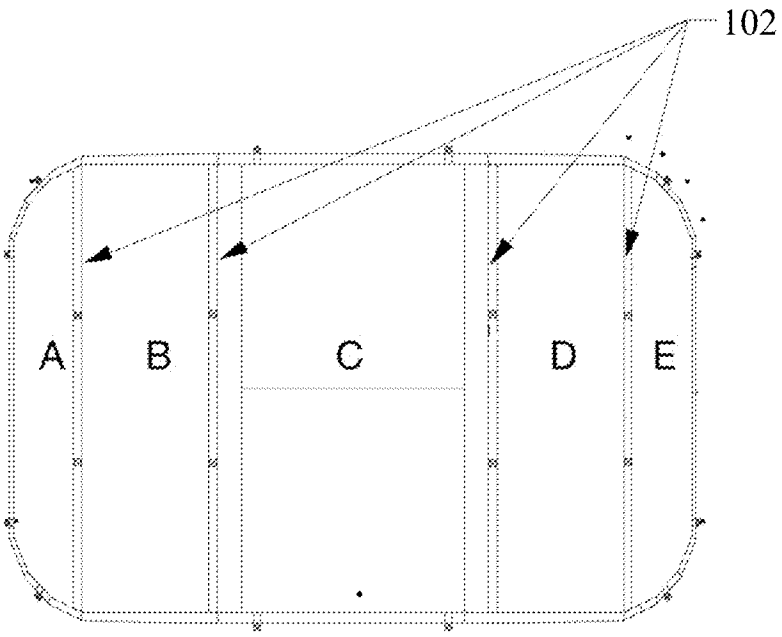
FIG. 6 is a top plan view of a portable and inflatable marine vessel canopy, wherein "A", "B", "C", "D", "E" represent panels utilized in the marine vessel canopy in accordance with one embodiment of the present invention.
Figure 8:
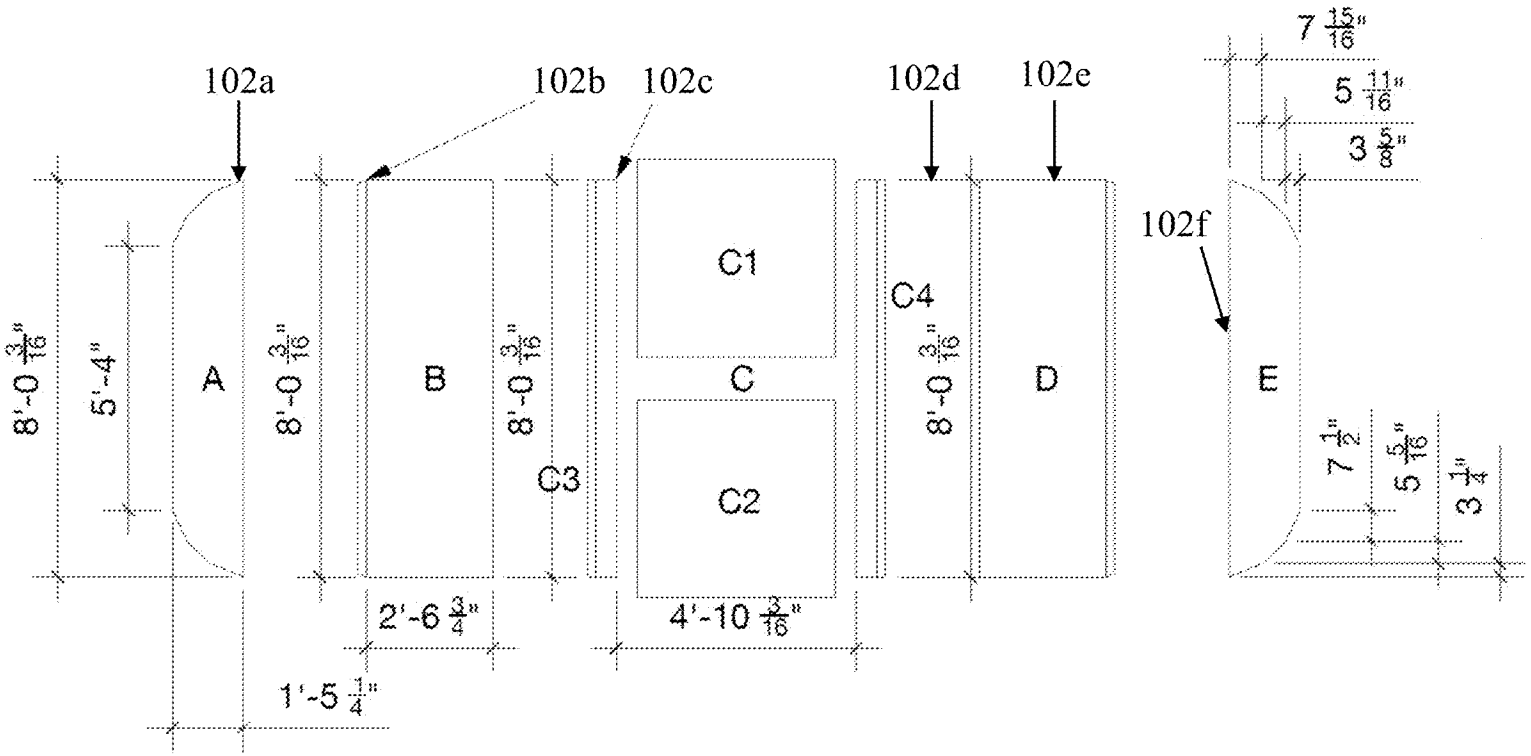
FIGS. 8-9 are exploded views of the portable and inflatable marine vessel canopy in FIG. 7 and with exemplary dimensions.
Figure 9:
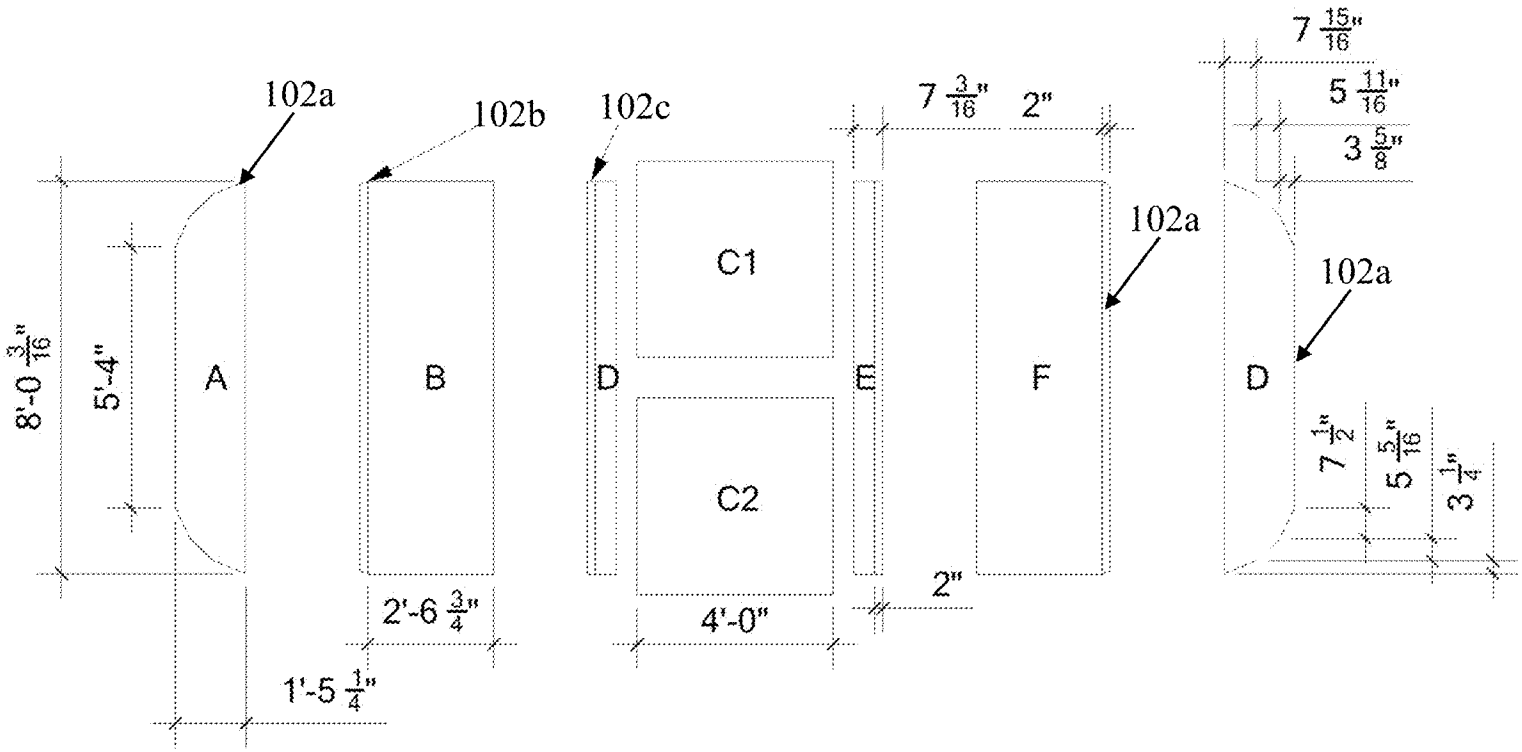
Figure 11:
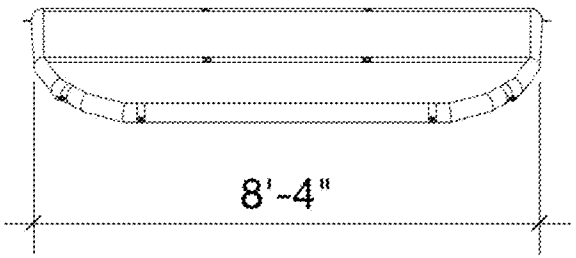
FIG. 11 is an elevational left-side view (which is identical to the right-side view) of the portable and inflatable marine vessel canopy in FIG. 1.
Figure 10:
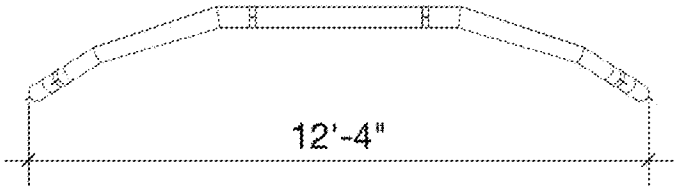
FIG. 10 is an elevational front view (which is identical to the rear view) of the portable and inflatable marine vessel canopy in FIG. 1.

Referring now to FIG. 6, the covering panel 102*c* marked as Panel C may comprise a fastener configuration consisting of 3 zippers to make space to accommodate equipment installed on top of a Bimini top or T-top. Panels A, B, D, and E are permanently attached to the flexible tubular frame 104. As best depicted in FIGS. 6-8, the canopy 100 is approximately 12 feet 4 inches long and 8 feet 4 inches wide in a preferred embodiment to span across a Bimini top or T-top as well as cover additional surface area that the Bimini top or T-top does not. FIGS. 13-15 depict various configurations of the canopy 100 on a marine vessel, e.g., covering the back, side, or top of the marine vessel. The canopy 100 is operably configured to be rotatable by the user quickly and easily into alternate configurations.

Figure 12:
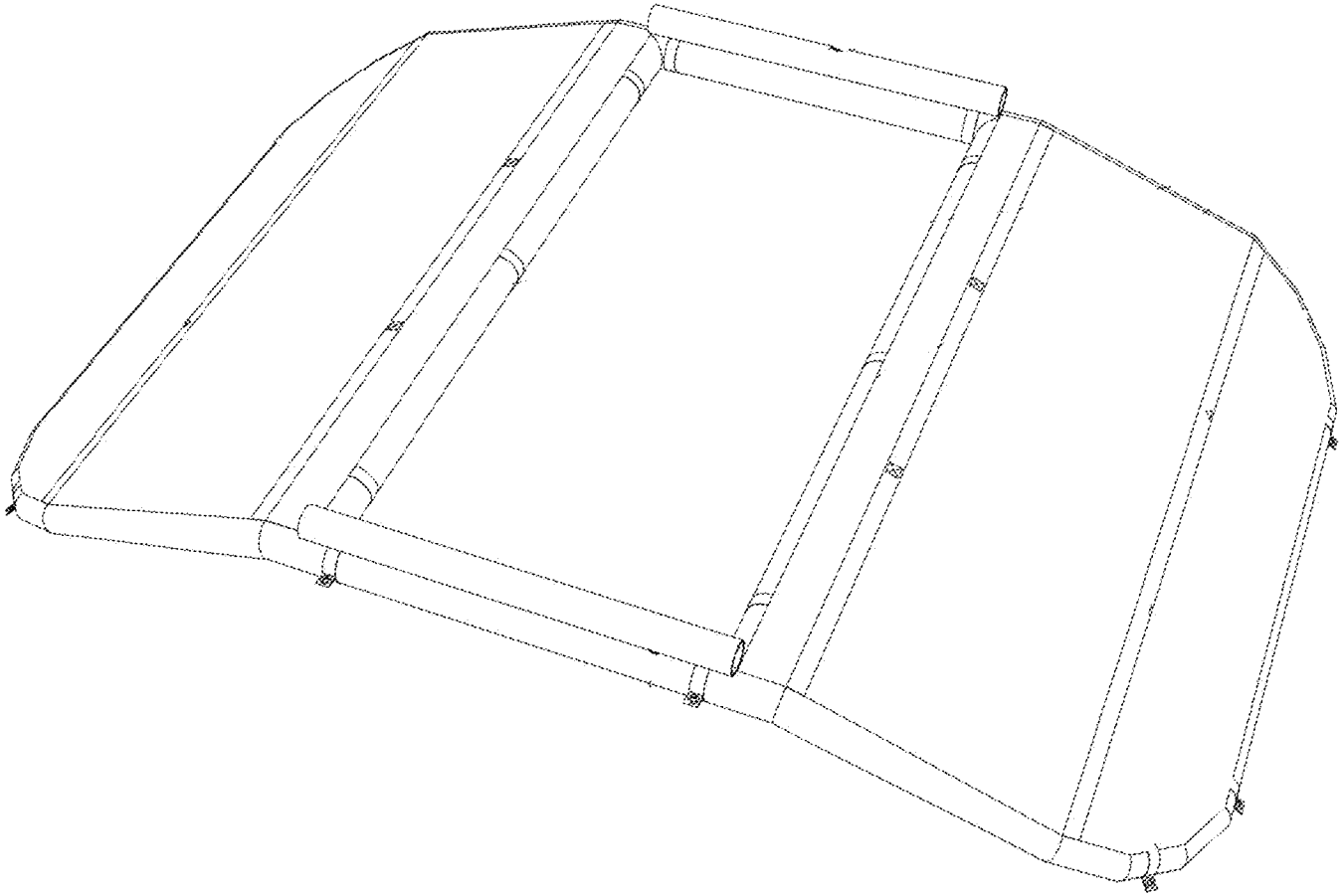
FIG. 12 is a perspective view of the portable and inflatable marine vessel canopy in FIG. 1 with two panels in a rolled configuration in accordance with the present invention.

As best depicted in FIG. 12, Panel C of the canopy 100 (i.e., covering panel 102*c*) may be operably configured into a rolled-up position to provide for a greater movement of wind or air flow through the canopy 100 and to allow the influx of sunlight if desired. When configured into a rolled-up position, the covering panel 102*c* enables the user to see out and through the top of the marine vessel, provided, however, that no other substantial visual obstructions (e.g., structural portions of a Bimini top or T-top) are present. Additionally, this feature also beneficially allows the user to reduce the canopy 100 into a compact and portable assembly that can then be easily stored and transported without a significant spatial footprint.

What is claimed is:

1. A portable and inflatable marine vessel canopy comprising:

a flexible tubular frame having a plurality of frame elements coupled together and each defining an enclosed internal frame channel and the flexible tubular frame having two lateral frame elements, the flexible tubular frame having an inflation valve coupled thereto and operably configured to provide fluid communication to the enclosed internal frame channel of the plurality of frame elements and to generate an inflated, hermetically sealed, and enclosed frame configuration with the plurality of frame elements defining a frame opening, the two lateral frame elements spanning to and from two opposing sides of the inflated and enclosed frame configuration and separating the frame opening into side frame openings and a central frame opening;

a plurality of covering panels each of a polymeric and flexible material and each coupled to the flexible tubular frame, covering the frame opening, and disposed in overlapping configuration with one another and forming a gap therein between to allow wind to pass through the overlapping covering panels; and a plurality of fasteners coupled to the flexible tubular frame and operably configured to selectively removably couple to a marine vessel.

2. The portable and inflatable marine vessel canopy according to claim 1, wherein:

the flexible tubular frame is of a polyurethane material.

3. The portable and inflatable marine vessel canopy according to claim 1, wherein the inflated frame configuration further comprises:

a central planar frame portion flanked by two angled frame portions.

4. The portable and inflatable marine vessel canopy according to claim 1, wherein the inflated frame configuration further comprises:

a central planar frame portion defined by the two lateral frame elements and having the central frame opening, the central planar frame portion flanked by two angled frame portions each having one of the side frame openings.

5. The portable and inflatable marine vessel canopy according to claim 4, wherein:

one of the plurality of covering panels covers the central frame opening and includes two portions operably configured to be selectively uncoupled from one another with a zipper assembly to expose the central frame opening.

6. The portable and inflatable marine vessel canopy according to claim 1, wherein:

the two lateral frame elements are disposed in a co-planar and parallel configuration with one another.

7. The portable and inflatable marine vessel canopy according to claim 1, further comprising:

lateral inflation apertures each respectively defined by, and disposed proximal to opposing ends of, the two lateral frame elements, wherein the two lateral frame elements each define an enclosed frame channel fluidly coupled to lateral inflation apertures respectively defined by the lateral frame element thereon and independently fluidly uncoupled to the enclosed frame channel defined by the plurality of frame elements generating the inflated and enclosed frame configuration; and inflation apertures defined by the plurality of frame elements generating the inflated and enclosed frame configuration and each respectively in fluid and hermetically sealed communication with the lateral inflation apertures with a plurality of hoses.

8. The portable and inflatable marine vessel canopy according to claim 7, wherein:

the enclosed frame channel defined by the plurality of frame elements generating the inflated and enclosed frame configuration is continuously defined by the plurality of frame elements.

9. The portable and inflatable marine vessel canopy according to claim 1, wherein:

the covering panels covering the central frame opening are maintained in a rolled configuration by at least one tethering strap.

10. The portable and inflatable marine vessel canopy according to claim 1, wherein:

the plurality of covering panels are of a polyethylene terephthalate material.

11. The portable and inflatable marine vessel canopy according to claim 1, wherein:

the plurality of covering panels are each coupled to the flexible tubular frame around a perimeter defined by the plurality of frame elements generating the inflated and enclosed frame configuration.

12. The portable and inflatable marine vessel canopy according to claim 1, wherein:

the plurality of covering panels overlap by approximately two inches.

13. The portable and inflatable marine vessel canopy according to claim 12, wherein:

the plurality of covering panels are directly coupled together by stitching at discontinuous points.

14. The portable and inflatable marine vessel canopy according to claim 1, wherein:

the plurality of fasteners comprise a first loop defining a fastener channel, wherein each of the frame elements are operably configured to be disposed within the fastener channel, and a secondary loop defining a loop channel.

* * * * *